US008959713B2

(12) United States Patent
Lagarde

(10) Patent No.: US 8,959,713 B2
(45) Date of Patent: Feb. 24, 2015

(54) DRIVING CARRIAGE FOR A SLIDING CURTAIN

(75) Inventor: Eric Lagarde, Sallanches (FR)

(73) Assignee: Somfy SAS, Cluses (FR)

( * ) Notice: Subject to any disclaimer, the term of this patent is extended or adjusted under 35 U.S.C. 154(b) by 0 days.

(21) Appl. No.: 13/638,180

(22) PCT Filed: Mar. 31, 2011

(86) PCT No.: PCT/FR2011/050722
§ 371 (c)(1),
(2), (4) Date: Dec. 12, 2012

(87) PCT Pub. No.: WO2011/121243
PCT Pub. Date: Oct. 6, 2011

(65) Prior Publication Data

US 2013/0074283 A1 Mar. 28, 2013

(30) Foreign Application Priority Data

Mar. 31, 2010 (FR) ..... 10 52428

(51) Int. Cl.

| | |
|---|---|
| ***A47H 15/00*** | (2006.01) |
| ***A47H 15/02*** | (2006.01) |
| *A47H 1/04* | (2006.01) |
| *A47H 23/02* | (2006.01) |

(52) U.S. Cl.
CPC ..... *A47H 15/02* (2013.01); *A47H 2001/045* (2013.01); *A47H 2023/025* (2013.01)
USPC ..... 16/102; 16/97

(58) Field of Classification Search
CPC ..... E05D 15/063; E05D 15/0652; E05D 15/0669; E05D 15/12; A47H 1/104; A47H 15/04; A47H 1/04; A47H 5/032
USPC .. 16/91, 94 R, 94 D, 95 R, 95 D, 96 R, 96 D, 16/97, 102; 49/409, 410, 425; 160/196.1, 160/199, 345; 4/557, 558, 607, 608
See application file for complete search history.

(56) References Cited

U.S. PATENT DOCUMENTS 316,969 A * 5/1885 High ..... 182/36
692,241 A * 2/1902 Cook ..... 16/98

(Continued)

FOREIGN PATENT DOCUMENTS

CN 1802486 7/2006
CN 101341308 1/2009

(Continued)

OTHER PUBLICATIONS

FR 2545711 A1—Machine Translation.*

(Continued)

*Primary Examiner* — Robert J Sandy
*Assistant Examiner* — Jason W San
(74) *Attorney, Agent, or Firm* — Patterson & Sheridan, LLP

(57) ABSTRACT

This driving carriage for a sliding curtain comprises a body that can move along a rail by virtue of two pairs of carrier wheels supported by the carriage, this body being provided, between the two pairs of carrier wheels along the longitudinal axis of the carriage, with at least one opening designed to receive a part of an inner curved edge of the rail without the rail striking the carriage. This eliminates or greatly limits the risks of the carriage becoming jammed along the rail.

16 Claims, 4 Drawing Sheets

(56) References Cited

U.S. PATENT DOCUMENTS

Figure 1:
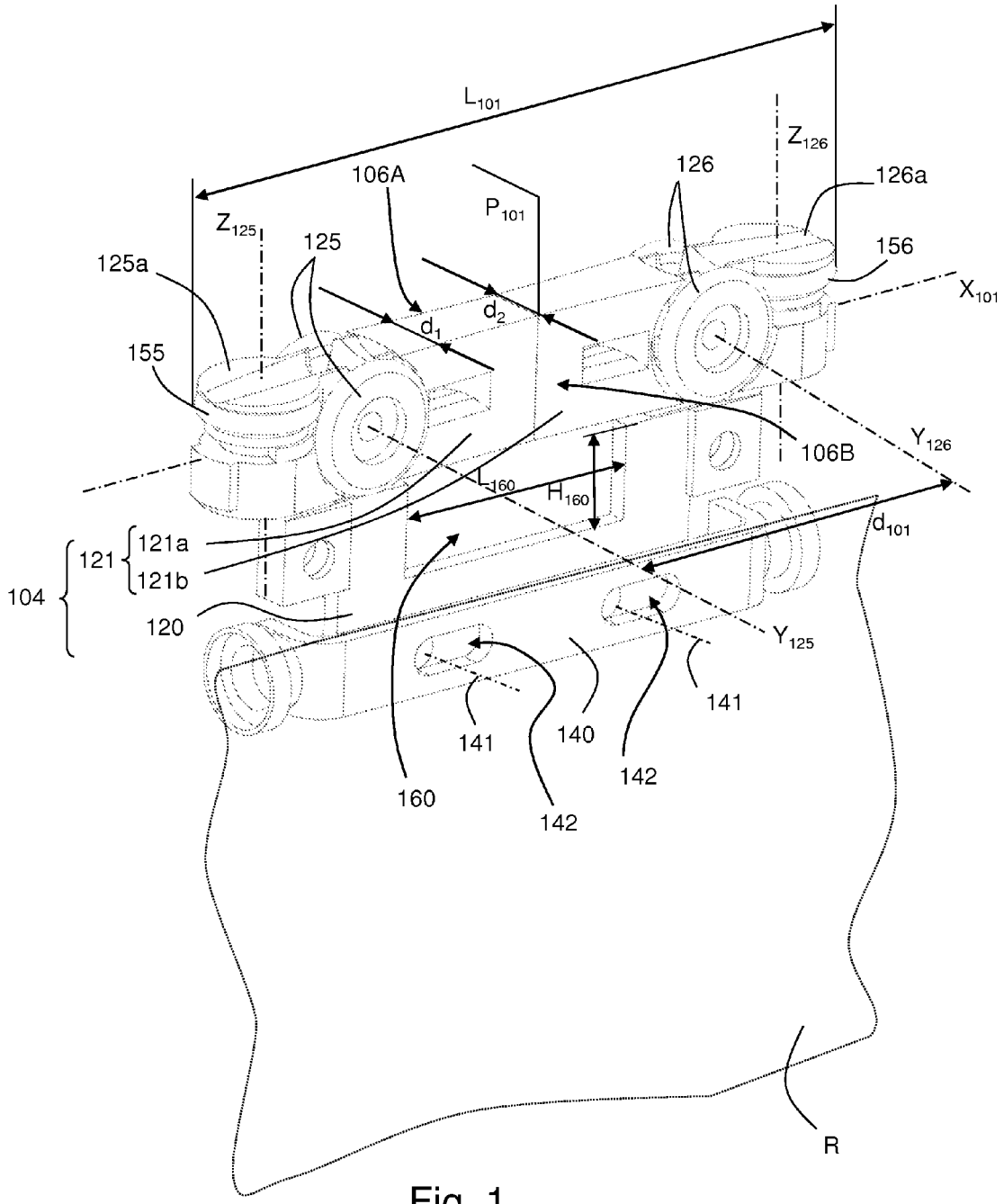

| | | | | | |
|---|---|---|---|---|---|
| 1,752,026 | A * | 3/1930 | Phillips | 105/163.1 |
| 1,819,379 | A * | 8/1931 | Nudelman et al. | 160/344 |
| 1,889,112 | A * | 11/1932 | Shoemaker | 16/97 |
| 2,539,064 | A * | 1/1951 | Ernest | 49/440 |
| 2,732,966 | A * | 1/1956 | Schroeder et al. | 217/60 R |
| 3,430,678 | A * | 3/1969 | Barnes et al. | 160/346 |
| 3,580,183 | A * | 5/1971 | Nearman | 104/111 |
| 3,736,620 | A * | 6/1973 | Williamson | 16/87.4 R |
| 4,166,494 | A * | 9/1979 | Utting | 160/330 |
| 5,090,171 | A * | 2/1992 | Kano et al. | 52/243.1 |
| 5,351,739 | A * | 10/1994 | Levy | 160/124 |
| 5,560,417 | A * | 10/1996 | Smiley | 160/341 |
| 6,209,171 | B1 * | 4/2001 | Pelletier et al. | 16/97 |
| 6,463,625 | B2 * | 10/2002 | Mittag | 16/97 |
| 8,046,872 | B2 * | 11/2011 | Burgess et al. | 16/97 |
| 2010/0037427 | A1 * | 2/2010 | Burgess et al. | 16/97 |
| 2010/0038041 | A1 * | 2/2010 | Liao | 160/196.1 |
| 2010/0139037 | A1 * | 6/2010 | Hufen et al. | 16/88 |
| 2010/0313382 | A1 * | 12/2010 | Andren et al. | 16/98 |
| 2011/0030169 | A1 * | 2/2011 | Aebi et al. | 16/87.4 R |
| 2011/0094162 | A1 * | 4/2011 | Morris et al. | 49/409 |
| 2012/0240352 | A9 * | 9/2012 | Kondash et al. | 16/91 |
| 2013/0074283 | A1 * | 3/2013 | Lagarde | 16/102 |

FOREIGN PATENT DOCUMENTS

| | | | |
|---|---|---|---|
| DE | 202009005959 | * | 7/2009 |
| DE | 202009005959 | U1 | 7/2009 |
| FR | 2485361 | A1 | 12/1981 |
| FR | 2545711 | B1 | 7/1984 |

OTHER PUBLICATIONS

FR 2485361 A1—Machine Translation.*
International search report for application No. PCT/FR2011/050722 dated Jul. 28, 2011.

* cited by examiner

DRIVING CARRIAGE FOR A SLIDING CURTAIN

The invention relates to the field of closing or solar protection installations, and in particular that of sliding curtains. These curtains are generally fixed on a set of several runners, mounted on carrier wheels and comprising curtain fixing elements for the curtain, able to be displaced along a rail. A master carrier is driven along the rail by the intermediary of a belt or of a cord by a manual action of maneuvering or by the action of an electromechanical actuator. The movement of the master carrier drives the movement of the various runners, either by the intermediary of the curtain itself, or by cords connecting the first skid shoe to the master carrier and each skid shoe to the next one. In the case of curtains with several parts that close towards one another, each curtain span is driven by a master carrier. The master carrier also makes it possible to carry out the connection between the two ends of the belt, with the latter as such forming an endless drive element between two drive pulleys. Alternatively, the master carrier is self-propelled, i.e. the electromechanical actuator drives the movement of the master carrier directly, the master carrier driving the traction belt of the curtain.

Motorized curtains are commonly used in hotel rooms or conference centers, i.e. in premises that are very often designed by architects with sought esthetics. In particular, the curtains are mounted in front of non-planar openings and/or following themselves a curve in order to satisfy the esthetics of the premises.

The problem linked to master carriers for curtains that must follow curved rails has been known for a long time. In particular, GB-A-735305 describes an articulated master carrier adapted to pass the curves of the rail. The master carrier is made using a flexible band whereon are mounted plates provided with vertical and horizontal wheels. The master carrier is as such capable of rolling along a rail in a V shape over a plurality of wheels, while still accepting distortions in a plane perpendicular to its longitudinal axis, for the passage of the curves of the rail. The curtain is moreover mounted on simple runners with a single pair of wheels on the same axis perpendicular to the rail.

Alternatively to the mounting on a flexible band, the various subassemblies of the master carrier can be articulated through the means of hinges. GB-A-735305 describes a solution of this type, but does not provide any additional details on this construction.

JP-A-04 079916 describes a system of motorization of the linear type wherein a driving master carrier for a curtain is also composed of several subassemblies articulated through the means of hinges.

These articulated master carriers can lack in rigidity for the passage of straight portions of the rail, which risks causing substantial friction if the master carrier is folded or is twisted when this is not necessary.

It is moreover known in FR-A-2 545 711 to provide curvilinear protrusions on either side of the body of constant thickness of a master carrier. These protrusions interact only with the edges of a rail on which is suspended the master carrier. In a curve, an edge of the rail risks striking the body of constant thickness.

DE-U-20 2009 008 959 discloses a master carrier formed from a flexible rail comprised of two portions that can be separated, with an upper portion provided with notches for mounting accessories. As these notches are arranged at the high portion of the master carrier, they cannot interact with the lower edges of a rail supporting this master carrier.

Finally, FR-A-2 485 361 discloses a master carrier provided with a central narrow opening of which the function is not specified. If an edge of a rail penetrates into this opening, it necessarily touches one of its sides, except if it has a very small radius of curvature, to the extent that the wheels of the master carrier may not be pressing against this rail.

The invention therefore proposes to overcome the aforementioned problems and to supply a master carrier structure that meets the technical needs and rigidity sought in the field of driving sliding curtains.

The master carrier according to the invention comprises a body provided to be displaced along a rail thanks to two pairs of carrier wheels supported by the master carrier. This master carrier is characterized in that its body is provided, between the two pairs of carrier wheels along a longitudinal axis of the master carrier, with at least one opening adapted to receive a portion of an inner curved edge of the rail, without the rail striking the master carrier.

Thanks to the invention, the opening of the body of the master carrier prevents the rail from striking the master carrier, on the interior of a curve when a portion of this master carrier is located at the front of this curve and when its other portion is located at the rear of this curve. The invention therefore allows a master carrier to follow a curved rail, with a relatively small radius of curvature. In particular, the invention makes it possible to use for the passage of the curves of the rail a master carrier of which the body, which does not include articulated portions, is inexpensive and easy to implement.

According to advantageous but not mandatory aspects of the invention, such a master carrier may incorporate one or several of the following characteristics, taken in any technically admissible combination:

The body of the master carrier is rigid.

The body of the master carrier includes a base whereon is mounted at least one carrier wheel and a bracket fixed to the base and supporting the curtain, the opening being formed between the bracket and the base.

The base of the master carrier is advantageously of biconcave shape, i.e. having a lesser thickness in a median zone and a greater thickness towards its ends, the recess formed as such on either side of the base corresponding to a second opening.

The master carrier supports two sets of carrier wheels and the width of the base, measured perpendicularly to the forward direction of the master carrier and according to a horizontal direction in configuration for use of the master carrier in the rail, has, in a median portion of the base located midway between the axes of rotation of two sets of carrier wheels, a value less than the value of this width in the vicinity of these carrier wheels.

The carrier wheels are advantageously mounted on a support, preferentially pivoting in relation to the base, with this facilitating the positioning of the master carrier in a curved rail.

The support has a portion in the shape of a C able to cooperate, through engagement, with a pin of the base in order to form an articulation around the pivoting axis of the support.

The body of the master carrier forms an end stop of the pivoting of the support in relation to the base.

At least one guide wheel or roller is mounted on the support, with the possibility of rotation around an axis parallel to the axis of articulation of the support on the base of the master carrier. Such a guide small wheel or wheel limits the friction of the master carrier against the rail.

The base can be made using two portions each supporting at least one carrier wheel. In this case a pivoting support can be mounted on each of these portions, with the two supports in question being identical.

The base and the bracket can form a single part or two symmetrical portions are joined together on a median plane of the master carrier.

The master carrier is symmetrical according to a longitudinal plane perpendicular to a median plane of the master carrier.

The opening is a through opening.

The length of the opening, measured in parallel to a longitudinal axis of the master carrier, has a value greater than that of the height of the opening, measured in a longitudinal plane of the master carrier, according to a direction perpendicular to its longitudinal axis.

Figure 2:
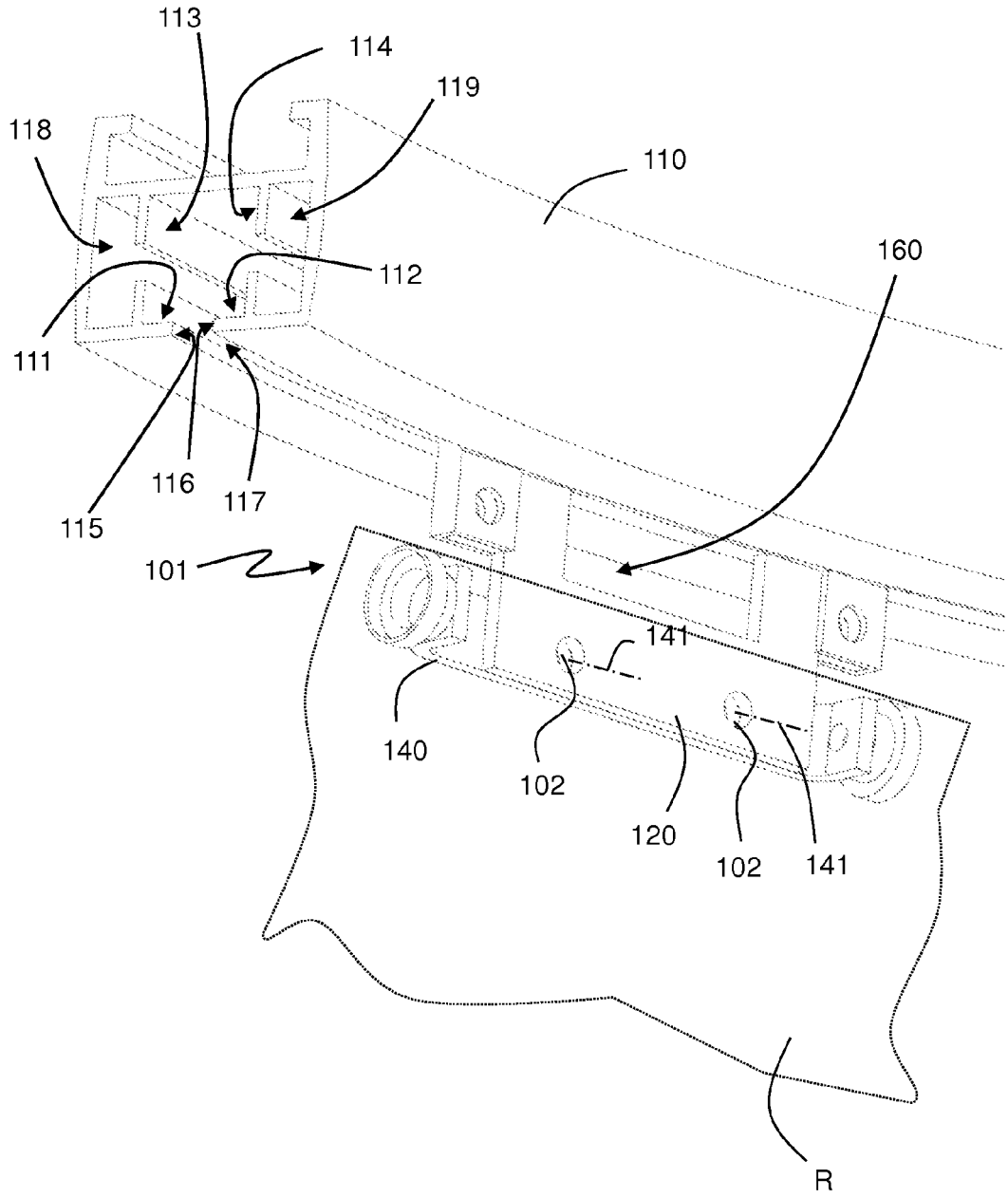
Figure 3:
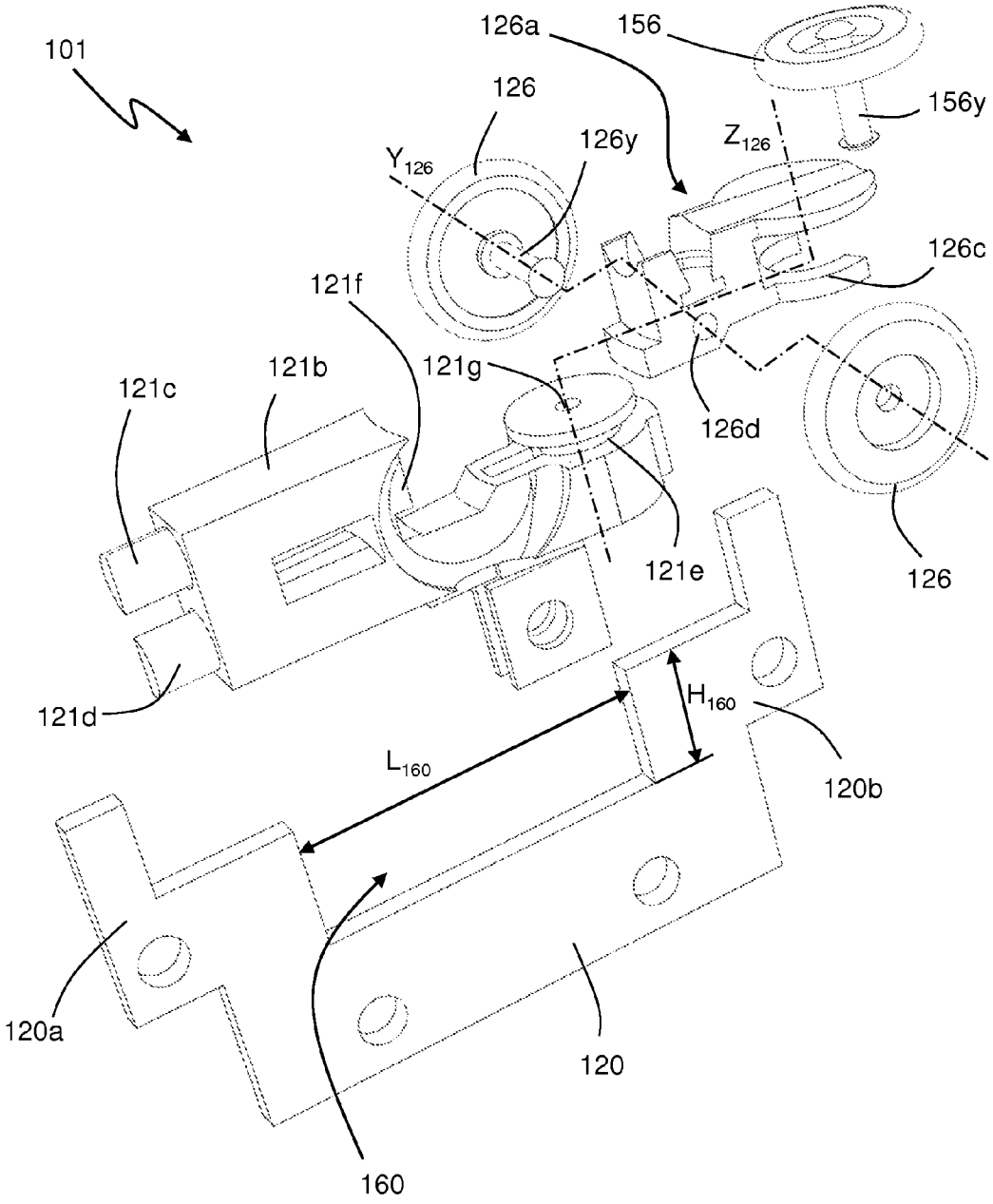
Figure 4:
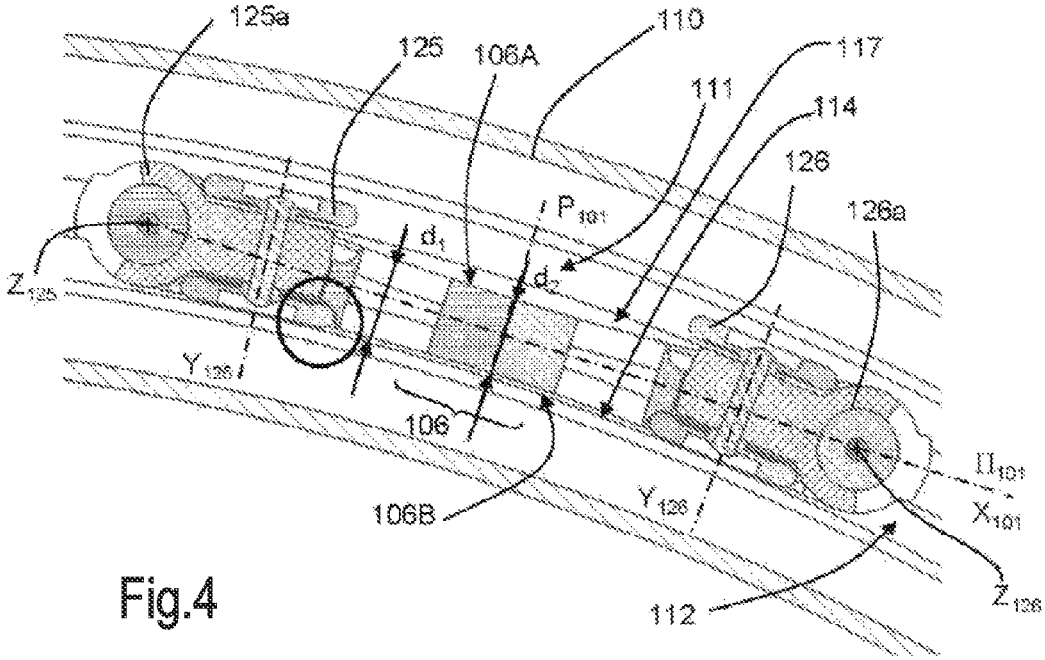
Figure 5:
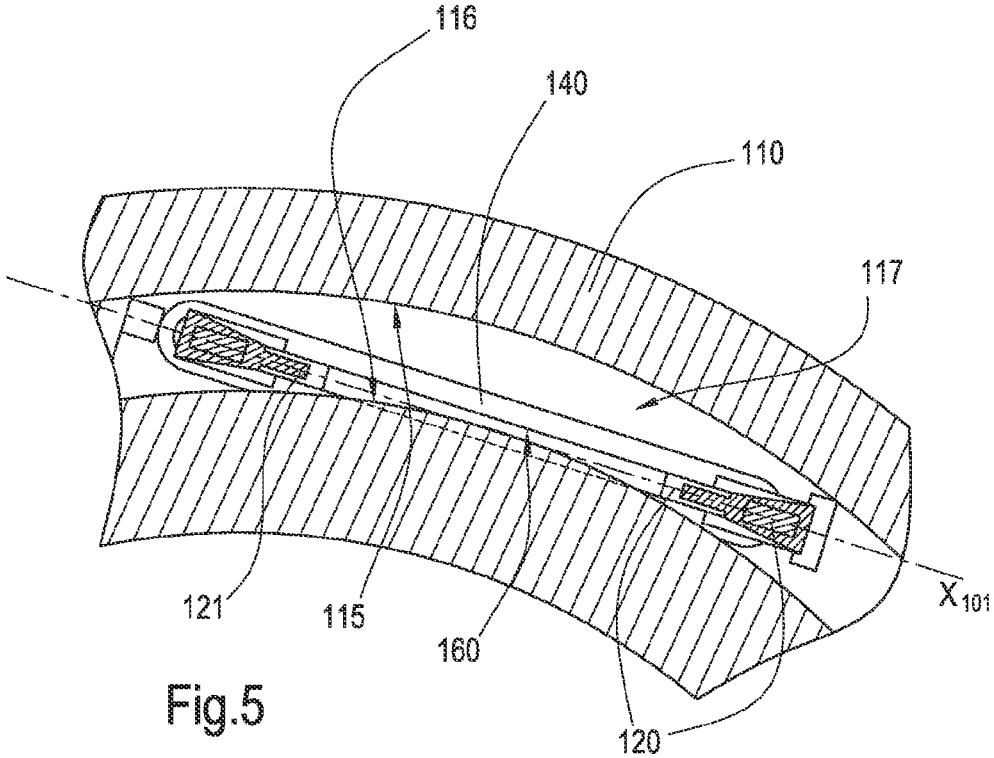

The invention shall be better understood and other advantages of the latter shall appear more clearly in the following description of an embodiment of a drive master carrier and of an installation in accordance with its principle, provided solely by way of example and made in reference to the annexed drawings wherein:

FIG. 1 is a perspective view of a master carrier in accordance with the invention, FIG. 2 is a perspective view of the master carrier in FIG. 1 being used in a solar protection installation, FIG. 3 is an exploded partial diagrammatical representation in perspective of the master carrier in FIGS. 1 and 2, FIG. 4 is a cross-section of the rail and of the master carrier in FIG. 2, on a first horizontal plane wherein is located an intermediary slot of the rail, and FIG. 5 is a cross-section of the rail and of the master carrier in FIG. 2, on a second horizontal plane wherein is located a lower wall of the rail.

The master carrier 101 shown in FIGS. 1 to 5 is intended to support a curtain R shown in chain dotted lines in FIGS. 1 and 2, with this curtain R being integral with an anchoring band 140, itself fixed to the master carrier 101, for example by means of fasteners 141 shown by their respective axes lines and which pass through orifices 142 arranged in the band 140 and orifices 102 arranged in the master carrier 101.

The master carrier 101 is provided to slide inside a rail 110 more particularly visible in FIGS. 2, 4 and 5 and which is formed by a metal profile.

The rail 110 of substantially rectangular section includes a central duct serving as housing for a portion of the master carrier and lateral ducts 118 and 119 wherein circulate a drive belt not shown. The central duct and the lateral ducts are each separated by an inner wall provided substantially at mid-height with a longitudinal slot. The belt is connected to the master carrier 101 through a longitudinal slot arranged in an inner wall of the rail and whereon is taken the cross-section in FIG. 4. The belt makes it possible to exert on the master carrier 101 a traction force of this master carrier along the rail 110. Advantageously, the drive belt of the master carrier 101 is itself driven by an actuator, also not shown, such as an electric motor. The lower inner surface of the central duct delimits two first rolling tracks 111 and 112 for the master carrier. The inner walls define inside of the central duct two second rolling tracks 113 and 114, perpendicular to the tracks 111 and 112. More precisely, in mounted configuration of the rail 110, the first tracks 111 and 112 are substantially horizontal, while the second tracks 113 and 114 are substantially vertical.

The master carrier 101 comprises two pairs of carrier wheels 125 and 126 intended to roll on the two first rolling tracks 111 and 112, during the displacement of the master carrier 101 along the rail 110.

The master carrier 101 is also provided with two guide wheels 155 and 156 which are provided in order to enter into contact with one of the two second tracks 113 and 114 arranged inside the rail 110, in particular when the forward direction of the master carrier separates from a longitudinal axis of the rail, in a curved portion of a rail or because of an external force exerted on the master carrier, for example by means of the curtain. The guide wheels 155 and 156 cooperate with one or the other of the tracks 113 and 114, according to the direction of curvature of the rail and/or of a force exerted on the master carrier by the curtain, in order to guide and center the master carrier 101 in relation to rail 110. Indeed, the diameter of a guide wheel is less than the width of the central duct wherein the master carrier is displaced.

$X_{101}$ denotes a longitudinal axis of the master carrier 101 which extends along the body 104 and which is parallel with the rail 110 when the latter is straight.

The body 104 of the master carrier 101 comprises a base 121 supporting the two pairs of carrier wheels 125 and 126 and the two guide wheels 155 and 156. The rigid base 121 is formed of two rigid portions 121*a* and 121*b* of plastic material mounted rigidly with one another. The two portions 121*a* and 121*b* are assembled with one another via nesting, thanks to complementary half-pins 121*c*, 121*d* which can be seen in FIG. 3 for the portion 121*b*. In practice, the portions 121*a* and 121*b* are identical. That is why only one of these portions is shown in FIG. 3, as well as the elements that it supports.

The body 104 further comprises a bracket 120 made of metal or plastic material with two teeth 120*a*, 120*b* each connected to one of the portions 121*a* or 121*b*. The assembly of the bracket on the basis defines an opening 160 between these two elements.

The body 104, which comprises the base 121 and the bracket 120, is rigid.

The rail 110 further comprises on its lower surface a longitudinal slot 117. This longitudinal slot defines two edges 115 and 116 between which passes a portion of the master carrier 101, in practice, the bracket 120, which extends beyond downwards in relation to the rail 110 in mounted configuration. As can be seen particularly in FIGS. 2 and 5, the slot 117 follows the configuration of the rail and can therefore be curved. Thanks to the presence of the opening 160, the edge 116 does not hinder the conveying of the master carrier 101 along the rail 110 in that the portion of the edge 116, which forms the inside edge of the slot 117 on the curve, can engage into the opening 160, without striking the bracket. In other terms, the opening 160 allows the master carrier 101 to follow the geometry of the rail 110 of which the radius of curvature can be relatively low, in particular less than 30 cm, even of a magnitude of 25 cm, without the risk of jamming against an edge of this rail.

$L_{160}$ denotes the length of the opening 160 measured in parallel to the axis $X_{101}$. $H_{160}$ denotes the height of the opening 160 measured perpendicularly to the axis $X_{101}$. The opening 160 is longer than it is high. In other terms, the length $L_{160}$ has a value greater than the height $H_{160}$, in practice at least twice as greater and more preferably of a magnitude of three times greater. This geometry of the opening 160 makes it particularly adapted for receiving the edge 116 without this edge striking the edges of the opening. This geometry provides, by the relatively low value of the height $H_{160}$, a good rigidity to the master carrier 101, despite the presence of the opening 160.

Along the axis $X_{101}$, the opening 160 is located between the pairs of carrier wheels 125 and 126.

$L_{101}$ denotes the length of the master carrier 101 which is greater than the distance $d_{101}$ between the axes of rotation $Y_{125}$ and $Y_{126}$ of the wheels 125 and 126, when these wheels are parallel to the axis $X_{101}$.

The length $L_{101}$ and the distance $d_{101}$ are measured parallel to the axis $X_{101}$. The higher the value of the distance $d_{101}$, the more the master carrier 101 is stable when it is pressing against the rail 110. However, the greater the distance $d_{101}$ is, the greater the risks of interference of the body 104 with the edges of the rail 110. That is why, the more the master carrier 101 is stable, therefore long, the more the opening 160 is useful.

In practice, the ratio of the value of the length $L_{160}$ over the value of the distance $d_{101}$ is greater than 0.5, more preferably greater than 0.65, further more preferably of a magnitude of 0.7.

Furthermore, the ratio of the value of the length $L_{160}$ over the value of the length $L_{101}$ is greater than 0.25, more preferably greater than 0.33, further more preferably of a magnitude of 0.4.

The value of the length $L_{160}$ is therefore chosen according to the geometry of the body 104 in order to prevent the clashes between the master carrier 101 and the rail 110.

In order to also allow for the passage of the master carrier, and in particular of the base, in the curved portions of the rail, the base has a biconcave configuration, with a minimum width in a median portion 106. As can be seen in FIG. 4, this prevents the median portion of the base from striking the vertical track 114 located on the inside of a curve of the rail 110. However, the base remains sufficiently massive to have good rigidity. For a curvature in the opposite direction, the biconcave configuration makes it possible to prevent a contact between the base and the vertical track 113. Indeed, the base is narrower in its median portion 106, located midway between the axes of rotation $Y_{125}$ and $Y_{126}$ of the wheels 125 and 126, than in the vicinity of these axes. More precisely, the width of the base is considered, which circulates inside the rail 110. This width is measured according to a direction perpendicular to the longitudinal axis $X_{101}$ of the body 104, i.e. to the forward direction of the master carrier 101 in the rail 110, perpendicularly to the axes $Z_{125}$ and $Z_{126}$ defined hereinafter, i.e. according to a horizontal direction in configuration for use of the master carrier 101. This width has a decreasing value, from the vicinity of the sets of carrier wheels 125 and 126 towards the plane $P_{101}$, i.e. towards the median portion 106. In other terms, the aforementioned width has a first value $d_1$ in the vicinity of the carrier wheels 125 and 126 and a second value $d_2$, less than the first, on the plane $P_{101}$, i.e. in the median portion 106.

As such, the base 121 is provided, on its sides and on its portion 106, with two hollow openings 106A and 106B, which result from the difference of the values $d_1$ and $d_2$, and which make it possible to receive a portion of the vertical tracks 113 and 114 in the curves of rail 110. The openings 106A and 106B are located, along the axis $X_{101}$, between the carrier wheels 125 and 126. Contrary to the opening 160, the openings 106A and 106B do not pass through.

The master carrier 101 is preferentially symmetrical in relation to a plane $P_{101}$ equally distant from the pairs of carrier wheels 125 and 126. Identical supports 125*a* and 126*a* connect the wheels 125 and 126 to the portions 121*a* and 121*b* that form the base 121 of the master carrier. Via simplicity, only one of these supports is described in what follows, i.e. the support 126*a* which can be seen in FIG. 3.

The support 126*a* is mounted pivotingly according to an axis $Z_{126}$ in relation to the portion 121*b* of the base. The axis $Z_{126}$ is vertical in the mounted configuration of the master carrier 101 on the rail 110. For this pivot connection, the support 126*a* includes a portion of rotation 126*c* in the shape of a C, which can rotate around a pin 121*e* of the portion 121*b*.

A rotating shaft 126*y* of the carrier wheels 126 is mounted on the support 126*a* by passing through an orifice 126*d* arranged in the support 126*a* and perpendicular to the axis of the portion 126*c*. As such, the carrier wheels 126 rotate around an axis $Y_{126}$ which is defined by the support 126*a* and which is perpendicular to the axis $Z_{126}$. The carrier wheels 126 pivot with the support 126*a* around the axis $Z_{126}$ in relation to the second portion 121*b* of the base 121.

A limitation to this movement of rotation is carried out by a stop 121*f* incorporated into the second portion 121*b* of the master carrier and cooperating with the carrier wheels 126 in order to limit the rotation of the support 126*a* in relation to the portion 121*b* of the base. This limitation of movement is shown in FIG. 4, in the zone marked by a black circle.

The pivoting movement authorized by the stop 121*f* is such that the wheels 126 do not enter directly into contact with the portion 121*b* during the use of the master carrier 101 in the rail 110, even if its radius of curvature is low, as seen hereinabove. On the other hand, the stop 121*f* limits the pivoting of the subassembly formed of the portions 126 and 126*a* before the master carrier is set into place in the rail. This provides an easy positioning of the master carrier in the rail, due to the good general resistance of the master carrier.

The base, and in particular the portion 121*b*, furthermore supports at least the guide or contact wheel 156, intended to prevent or limit the friction in the case where the master carrier enters into contact with the rail 110. This guide wheel is mounted thanks to a shaft 156*y* on an upper portion of the portion 121*b*. The axis of rotation of the guide wheel 156, which is defined by the shaft 156*y* is in fact confounded with the axis $Z_{126}$. Indeed, the shaft 156*y* is introduced into a housing of corresponding shape 121*g* arranged at the center of the pin 121*e* and coaxial with the latter. Alternatively, the axis of rotation of the guide wheel 156 can be parallel to the axis $Z_{126}$ without being superimposed with the latter. The wheel 156 is more particularly intended to roll on one of the tracks 113 and 114 in the curved zones of the rail 110, or in the straight zones, when a lateral force is exerted on the master carrier. The shaft supporting the guide wheel 156 can also serve as a pivot for the support of the wheels 126.

The wheel 156 can be replaced with two small wheels (not shown) each for a contact with an inside track of the rail, according to the direction of curvature of the rail.

The support 125*a* is, likewise, mounted pivotingly in relation to the portion 121*a*, around an axis $Z_{125}$ parallel to the axis $Z_{126}$, and this portion 121*a* carries a guide wheel 155.

More preferably, the master carrier 101 is symmetrical in relation to its longitudinal plane $\Pi_{101}$ which is perpendicular to the plane $P_{101}$, which passes through the axes $Z_{125}$ and $Y_{126}$ and wherein are measured the dimensions $L_{160}$ and $H_{160}$.

In the plane $\Pi_{101}$ or along the axis $X_{101}$, the opening 160 is located between the axes $Y_{125}$ and $Y_{126}$ when these two axes are perpendicular to this plane.

Thanks to the invention, the progression of the master carrier 101 along the rail 110 is not hindered in a curved zone or in the curve of the rail, which limits the torque that must be supplied by the drive motor of the master carrier in these zones. As the drive belt of the master carrier, received in the circulation ducts 118 and 119, constantly rubs against the vertical walls of the rail 10, it does not induce any variation in the torque that the motor must supply.

The invention claimed is:

1. An assembly, comprising:

a rail having a curved portion;

a sliding curtain; and a driving master carrier that supports the sliding curtain on the rail, the master carrier comprising an elongated body that is displaceable along the rail by two pairs of carrier wheels supported by the master carrier, the two pairs of carrier wheels being mounted to respective ends of the elongated body, wherein the body includes a longitudinal axis with at least one opening between the two pairs of carrier wheels, the at least one opening being of sufficient size to allow an inner curved surface of the curved portion to protrude into the at least one opening when the master carrier moves along the curved portion of the rail without contact between the rail and the body of the master carrier to prevent jamming between the rail and the master carrier at the curved portion.

2. The assembly according to claim 1, wherein the body is rigid.

3. The assembly according to claim 1, wherein the body includes a base and a bracket connected to the base, and the at least one opening is defined between the base and the bracket, and wherein at least one of the two pairs of carrier wheels is mounted on the base.

4. The assembly according to claim 3, wherein the base has a biconcave shape.

5. The assembly according to claim 3, wherein a width of the base, measured perpendicularly to a longitudinal direction of the master carrier decreases in a median portion of the base located midway between the axes of rotation of the two pairs of carrier wheels.

6. The assembly according to claim 3, further comprising a support associated with at least one carrier wheel, the support being mounted to the base to pivot about a pivot axis that is perpendicular to an axis of rotation of the carrier wheel.

7. The assembly according to claim 6, wherein the support has a C-shaped portion that engages with a pin of the base in order to carry out an articulation of the body around the pivot axis of the support.

8. The assembly according to claim 6, wherein the base forms a stop for limiting the pivoting of the support in relation to the base.

9. The assembly according to claim 6, wherein the support includes at least one guide wheel that is rotatable about an axis that is parallel to an axis of articulation of the support on the base.

10. The assembly according to claim 3, wherein the base comprises two separable portions, each portion including at least one carrier wheel.

11. The assembly according to claim 10, wherein a pivoting support is mounted on each portion.

12. The assembly according to claim 3, wherein the base and the bracket comprise a unitary structure.

13. The assembly according to claim 1, wherein the master carrier is symmetrical according to a longitudinal plane that is perpendicular to a median plane of the master carrier.

14. The assembly according to claim 1, wherein the opening is a through opening.

15. The assembly according to claim 1, wherein a length of the opening of the master carrier, measured parallel to a longitudinal axis of the master carrier, is greater than that of a height of the opening measured in a direction perpendicular to the longitudinal axis of the master carrier.

16. The assembly according to claim 3, wherein the base and the bracket comprise a structure including two symmetrical portions that extend on both sides of a median plane of the master carrier.

* * * * *